US009498965B2

(12) United States Patent
Pagnon

(10) Patent No.: US 9,498,965 B2
(45) Date of Patent: Nov. 22, 2016

(54) CARTRIDGE WITHOUT AN INADMISSIBLE OVERPRESSURE

(71) Applicant: Dover Europe Sarl, Vernier (CH)

(72) Inventor: Alain Pagnon, Bourg les Valence (FR)

(73) Assignee: DOVER EUROPE SÁRL, Vernier (CH)

( * ) Notice: Subject to any disclaimer, the term of this patent is extended or adjusted under 35 U.S.C. 154(b) by 0 days.

(21) Appl. No.: 14/878,214

(22) Filed: Oct. 8, 2015

(65) Prior Publication Data

US 2016/0101627 A1 Apr. 14, 2016

(30) Foreign Application Priority Data

Oct. 9, 2014 (FR) ..... 14 59705

(51) Int. Cl.
*B41J 2/175* (2006.01)

(52) U.S. Cl.
CPC ..... *B41J 2/17506* (2013.01); *B41J 2/17513* (2013.01); *B41J 2/17556* (2013.01)

(58) Field of Classification Search
CPC .. B41J 2/175; B41J 2/17506; B41J 2/17513; B41J 2/17556; B41J 2/17593; B41J 2/17596; B41J 2002/17516; F17C 5/06; F17C 13/026; F17C 2250/043; F17C 2250/0439; F17C 2250/0621; F17C 2250/0626; F17C 2250/0631
See application file for complete search history.

(56) References Cited

U.S. PATENT DOCUMENTS

| | | | | |
|---|---|---|---|---|
| 5,016,684 | A * | 5/1991 | Clusserath | B67C 3/12 141/39 |
| 5,628,349 | A * | 5/1997 | Diggins | F17C 5/06 141/3 |
| 6,073,081 | A * | 6/2000 | Hettinger | F17C 5/02 702/50 |
| 6,969,161 | B2 * | 11/2005 | Kuwabara | B41J 2/17509 347/85 |
| 7,152,637 | B2 * | 12/2006 | Hoke, Jr. | F17C 5/007 141/192 |
| 8,783,303 | B2 * | 7/2014 | Harty | F17C 5/007 141/11 |
| 2002/0071011 | A1 | 6/2002 | Hayashi | |
| 2007/0139492 | A1 | 6/2007 | Anderson, Jr. | |
| 2007/0222829 | A1 | 9/2007 | Stathem | |

FOREIGN PATENT DOCUMENTS

| | | | |
|---|---|---|---|
| EP | 0 765 756 | A2 | 4/1997 |
| EP | 0 968 831 | A1 | 1/2000 |
| EP | 1 707 377 | A1 | 10/2006 |
| GB | 2481599 | A | 1/2012 |
| WO | 2004/028817 | A1 | 4/2004 |
| WO | 2009/047501 | A1 | 4/2009 |

(Continued)

OTHER PUBLICATIONS

Search Report issued in French Patent Application No. FR 14 59705 dated Jun. 25, 2015.

(Continued)

*Primary Examiner* — Anh T. N. Vo
(74) *Attorney, Agent, or Firm* — Pearne & Gordon LLP

(57) ABSTRACT

The invention relates to an ink and/or solvent cartridge (10) for an industrial printer, such a cartridge including at least one semi-rigid or deformable volume (14), being provided with an aperture (16), and having a given maximum capacity VCmax, and holding a hermetically enclosed volume of liquid comprising an ink and/or a volatile solvent, and a gas volume, the sum of these 2 volumes being lower than the maximum capacity VCmax, and in the whole temperature range between 10° C. and 35° C. and for a 1 bar pressure.

16 Claims, 5 Drawing Sheets

(56) References Cited

FOREIGN PATENT DOCUMENTS

| | | | |
|---|---|---|---|
| WO | 2009/072656 | A1 | 6/2009 |
| WO | 2012/086380 | A1 | 6/2012 |

OTHER PUBLICATIONS

Written Opinionand Search Report issued in European Patent Application No. EP 15 188 832 dated Feb. 9, 2016.

* cited by examiner

CARTRIDGE WITHOUT AN INADMISSIBLE OVERPRESSURE

TECHNICAL FIELD AND STATE OF PRIOR ART

The invention relates to the field of printers in particular that of industrial printers using solvent inks, for example CIJ printers. The ink circuit of these printers has removable ink and fresh solvent tanks held in cartridges, flasks or containers.

The invention relates to a cartridge, right after its manufacture and before its use for a CIJ-type printing machine.

The invention also relates to a method for filling this cartridge.

It also relates to a device for filling this cartridge.

Industrial printers are well known in the field of industrial coding and labelling for various products, for example to label bar-codes, expiration date on food products, or even references or distance marks on cables or pipes directly on the production line at a high rate. Among these printers, some of them make use of technologies using liquid inks with a solvent they deposit onto the medium/product to be printed. To operate, they need a fresh ink tank, or even also a fresh solvent to feed printing. By way of example, there can be mentioned continuous ink-jet (CIJ) printers which belong to this kind of printer.

The latter has several standard sub-assemblies as shown in FIG. 1.

First, a printing head 1, generally offset from the body of the printer 3, is connected thereto by a flexible umbilical 2 joining the hydraulic and electrical connections required for operating the head by imparting it a flexibility which facilitates integration on the production line.

The body of the printer 3 (also called a console or cabinet) usually contains three sub-assemblies:

- an ink circuit 4 at the bottom of the console (zone 4'), which enables on the one hand, ink to be provided to the head at a stable pressure and with a suitable quality, and on the other hand the jet ink not used for printing to be dealt with;
- a controller 5 located at the top of the console (zone 5'), capable of managing the action sequencing and performing processes enabling different functions of the ink circuit and of the head to be activated,
- an interface 6 which gives the operator means for implementing the printer and to be informed about its operation.

The ink circuit can be of the type described in EP0968831, where the ink and solvent (also called an additive) tanks are removable cartridges including a semi-rigid pocket of a plastic material, compatible with the fluids in question. This principle is found in several machines sold by major operates on the markers as the product line series, 7, 9020, 9030, 9232 from Markem-Imaje or Series 1000 from Videojet (WO2009047501).

One example of such a cartridge 10 is represented in FIG. 2.

It includes a rigid portion 12 and a semi-rigid or flexible portion 14. The rigid portion 12 is provided with a rigid mouthpiece (or nose) 16 enabling the ink circuit to be hydraulically connected thereto. Initially, the mouth is closed by a capsule of a rubber-type material, for example of EPDM, or other (chemically compatible with the fluids in question), being hermetically crimped or sealed. Upon setting up the cartridge, a hollow needle, linked to the ink circuit, hits the capsules and establishes the hydraulic circuit between the cartridge and the ink circuit. The elastic material of the capsule is chosen to ensure the sealing of the needle-capsule junction.

The semi-rigid nature of the pocket is more or less strong depending on the solutions and some of them have some strength which enables them to be handled without a protection (the cartridge thus consists of the pocket), whereas others are protected by a rigid cover (the cartridge consists of the pocket and the cover).

Filling these cartridges has to satisfy some regulatory requirements. Indeed, solvents used in the inks are often very volatile (alcohol, MEK, acetone, . . . ) and their transport is subjected to strict rules, in particular in terms of filling rate of the pockets.

The European agreement concerning the international transport of dangerous goods by road ADR 2013 volume II, paragraph 4.1.1.4, gives a table indicating the % maximum filling rate of the capacity of the package as a function of the boiling point Bp.

For MEK (Bp 79.6° C.), this rate is 92% and for acetone (Bp 56.1° C.), it is 90%

Therefore, an 800 ml volume of MEK has to be held in a cartridge having a capacity of at least 870 ml (800/0.92). Likewise, an 800 ml volume of acetone has to be held in a cartridge having a capacity of at least 890 ml (800/0.90). This requirement has to be satisfied upon filling the cartridge, that is during its production.

In Prior art, the production of cartridges is thus made by partially filling the pockets in the requested proportions and by sealing them to make them hermetic. This operation is made under ambient conditions. For transport cost reasons, it is attempted to optimize the loading volume/carried volume ratio, the volume of liquid (ink, solvent) is thus generally maximized in each cartridge.

These cartridges are then sold all over the world, they can be led to undergo significant temperature variations of a climatic origin as well as ambient atmospheric pressure variations. On the other hand, being placed inside a printer, they support an increase in temperature related to the thermics of the machine. As a result, these sealed and hermetic cartridges, being partially filled with solvent vapour saturated air, have to support temperature variations that can reach about thirty degrees C.

For example, when filled a 18° C., the cartridges can be used at 45° C. The air expansion and increase in the solvent saturation vapour pressure as a function of the increase in temperature result in a significant increase in the pressure in the cartridge relative to the ambient atmospheric pressure causing several problems:

- the semi-rigid pocket, being not yet hit, swells to such a point that it can no longer be used because of its overall dimensions. There is also a risk of cracking or even bursting of the pocket which can result in serious problems in view of the flammability of the solvents;
- at the time when the cartridge is hit, the overpressure in the pocket does not enable to ensure the sealing of the needle-capsule junction which leads to an always hazardous leak risk (ignition or vaporisation of noxious products).

DISCLOSURE OF THE INVENTION

In order to solve these problems, the invention first relates to an ink and/or solvent cartridge, for a printer, for example an industrial printer, and including at least one semi-rigid or deformable volume (or even a pocket), this cartridge:

being provided with at least one hermetically closed aperture (or mouthpiece or nose), having a given maximum capacity VCmax, holding a hermetically enclosed volume of liquid comprising an ink and/or a volatile solvent, and a gas volume, the sum of these 2 volumes being lower than the maximum capacity VCmax, in a temperature range preferably between 0° C. and 45° C. (or for a temperature ranging from 0° C. or 10° C. to 35° C. or 45° C. or for all temperatures from 0° C. or 10° C. to 35° C. or 45° C.) and for a 1 bar pressure.

The maximum capacity VCmax of the cartridge is that enabling the atmospheric pressure inside the cartridge not to be exceeded.

The VCmax value can be within a wide range, for example between 50 $cm^3$ and 3 l, corresponding to very variable cartridge sizes. But the invention is also applicable to a cartridge having the form of a can of several tens litres, or more.

The ratio of the sum of the volumes held in the cartridge to the VCmax volume can be between 75% and 80%.

According to one example, VCmax is between 850 $cm^3$ and 870 $cm^3$, the sum of both volumes (liquid and gas) being then between 662 $cm^3$ and 678 $cm^3$.

The liquid can be, or contain, a solvent, for example of the alcohol, or MEK, or acetone type.

Preferably, the cartridge has a filling rate (volume of liquid to the total volume) lower than 95% or 90%.

Advantageously, the mechanical resilience of the flexible or deformable portion of the cartridge enables it to come back to its initial shape, after deformation, and results in the cartridge being in slight underpressure after filling and hermetic crimping or sealing. This is advantageous to avoid leaks upon placing the cartridge into a printer.

A cartridge according to the invention can have several sealed or closed apertures (or mouthpieces or noses), for example one aperture for filling the cartridge and another one for feeding the printer and through which the liquid can flow towards the printing head. All apertures are hermetically sealed, there is no other aperture.

The invention also relates to a method for calculating the volume of liquid to be introduced into an ink cartridge, in particular according to the invention and such as described above, and for holding solvent and/or ink, including determining or calculating said volume of liquid to be introduced, such that the sum of this volume and of a, or the, gas volume, held or to be held in the cartridge and consisting of air and vapour of the liquid, remains lower, or strictly lower, than the maximum capacity VCmax of the cartridge in a temperature range preferably between 0° C. (or 10° C.) and 45° C. (or 35° C.) (or for a temperature ranging from 0° C. or 10° C. to 35° C. or 45° C. or for all temperatures from 0° C. or 10° C. to 35° C. or 45° C.) and for a 1 bar pressure or for an ambient atmospheric pressure, equal to or of the same order as that present upon filling.

The invention also relates to a method for filling a cartridge, in particular for producing cartridges such as that according to the invention and described above.

Such a cartridge includes at least one semi-rigid or deformable volume (or even a pocket), is provided with an aperture, and has a maximum capacity VCmax, already defined above.

Such a method for filling such an ink and/or solvent cartridge, for an industrial printer, includes:

partially filling said cartridge, by introducing therein a volume of liquid comprising an ink and/or a volatile solvent, which leaves a gas volume in the cartridge, the sum of this volume of liquid and of the gas volume, held or to be held in the cartridge and which can consist of air and vapour of the liquid, being equal to a filling volume VC, which remains lower or strictly lower, or strictly lower, than said maximum capacity VCmax in a temperature range, preferably between 0° C. and 45° C., and for a 1 bar pressure, or for an ambient atmospheric pressure equal to, or in the same order as, that present upon filling;

hermetically sealing said cartridge.

According to the invention, the cartridge is filled under ambient conditions of production or filling, for example at 1 bar, with a total volume, comprising a volume of liquid and a gas volume, lower than the maximum volume VCmax of the cartridge.

This results in a cartridge having, after filling and sealing, a shape suitable for the volume its holds, thus not corresponding to a cartridge filled to a maximum under the conditions used upon filling. Under ambient conditions during use, the gas volume will increase without causing an overpressure in the cartridge with respect to the local atmospheric pressure.

The aforesaid drawbacks thus disappear or are, at the very least, very strongly lessened. The operating temperature range can be between 0° C. and 45° C. or, for example, between 10° C. and 35° C.

According to a particular embodiment:

before introducing the liquid, a reduction in the volume of the cartridge to the filling volume VC, lower, or strictly lower, than said maximum capacity VCmax is conducted, and a volume of liquid comprising an ink and/or a volatile solvent is introduced therein, such that the sum of this volume of liquid and of the gas volume is equal to said filling volume.

The reduction of said volume can be made before introducing the liquid, by applying a pressure on the deformable volume.

The cartridge can have several sealed or closed aperture, for example one aperture for filling the cartridge and another one for feeding a printer and through which the liquid can flow from inside the cartridge towards the printing head.

The cartridge can be filled with a filling rate, or ratio of the volume of liquid to the total volume, which can be lower than 95% or 90%.

In a cartridge or in a method according to the invention, the cartridge has a semi-rigid or deformable volume which is preferably a single volume or compartment.

The invention also relates to a tool or a device for aiding in filling an ink and/or solvent cartridge for an industrial printer, such a cartridge including at least one semi-rigid or deformable volume (or even a pocket), and being provided with an aperture, this device including:

a housing for accommodating at least one part of said semi-rigid volume (pocket);

means for applying a pressure on said semi-rigid volume.

Said housing can be partially closed by a movable flap.

This tool can be implemented upon filling a cartridge according to the above described method according to the invention or for making a cartridge according to the invention.

Such a tool or device can further include means for calculating a volume of liquid, comprising an ink and/or a volatile solvent, to be introduced into the cartridge, such that the sum of this volume of liquid and of the gas volume, held or to be held in said cartridge, and which can consist of air and the vapour of said liquid, remains lower, or strictly lower, than said maximum capacity VCmax, in a temperature range, preferably between 0° C. and 45° C., and for a 1 bar pressure, or for an ambient atmospheric pressure equal to or in the same order as that present upon filling.

Said calculating means can also be means for controlling the means for applying a pressure on said semi-rigid volume.

By implementing the invention, the overpressures, in the cartridges in use, under detrimental ambient conditions, disappear or are strongly lessened for extreme conditions.

A printer, for example an ink-jet printer such as a continuous ink-jet CIJ printer, can implement one or more cartridges, in particular an ink cartridge according to the invention and/or a solvent cartridge according to the invention. The invention thus also relates to the operation, with at least one cartridge according to the invention, of a printer, in particular an ink-jet printer such as a continuous ink-jet CIJ printer.

DETAILED DISCLOSURE OF PARTICULAR EMBODIMENTS

Figure 1:
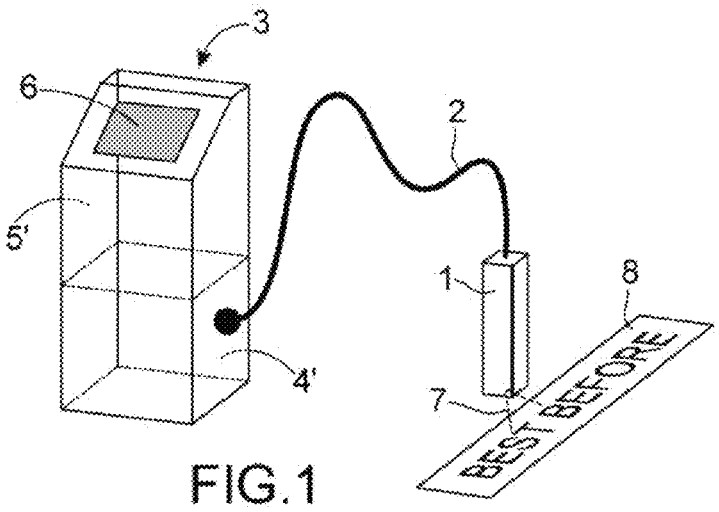
FIG. 1 represents a known structure of the CIJ-type printer.
Figure 2:
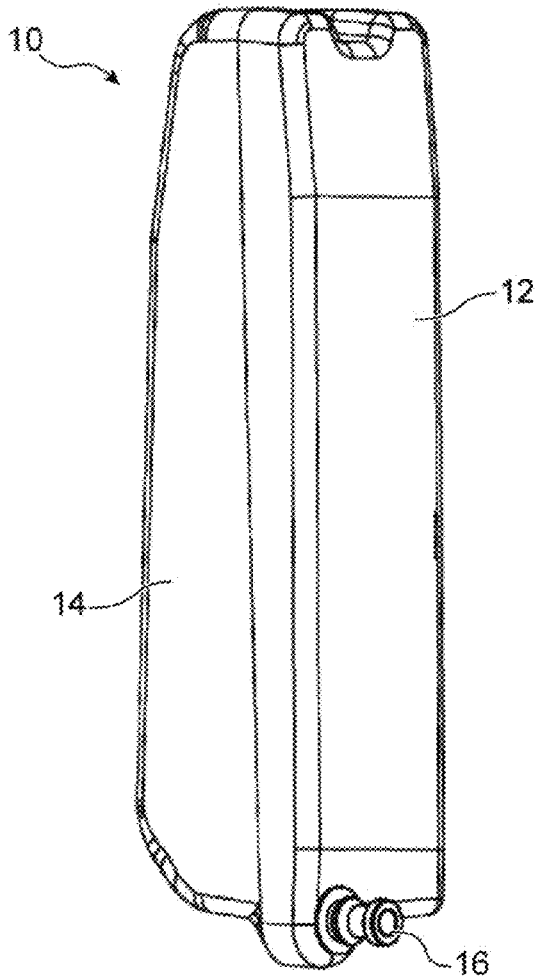
FIG. 2 represents an exemplary CIJ printer cartridge.

First, the initial conditions upon filling and sealing or crimping (or a hermetic closing) of a cartridge as that, for example, of FIG. 2 are considered. The initial shape of the cartridge is the shape at rest when there is no mechanical stress and the inner and outer gas pressures are balanced.

All the pressures set forth hereinbelow are absolute pressures.

Let us define:

VC: the total volume held in the cartridge;

VCmax: the volume of the empty cartridge at rest and being opened (which balances the inner and outer pressures);

VL and ML are respectively the volume of liquid and the mass of liquid in the cartridge;

V is the gas volume in the cartridge;

Ti is the initial temperature of air (gases) enclosed upon crimping the cartridge;

V(Ti) is the initial air volume, saturated with solvent and enclosed in the cartridge upon crimping the cartridge;

P(Ti) is the initial ambient atmospheric pressure upon crimping the cartridge. A value close to 1 Bar ($10^5$ Pascal) can be taken. It will be noted that this pressure can vary as a function of weather and altitude.

Figure 3A:
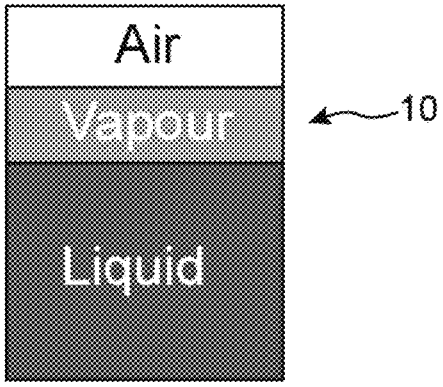
FIGS. 3A and 3B schematically represent the volumes of liquid and gas held in a cartridge, under the initial (FIG. 3A) and final (FIG. 3B) conditions.

FIG. 3A schematically represents the fluid distribution in the cartridge 10 after filling. Besides liquid (for example solvent), there is also vapour of this liquid, and air.

As physical data of the liquid, there are:

Psat (T)=Saturation vapour pressure of the liquid;

Rho (T)=Density of the liquid.

Under the final operating conditions (FIG. 3B), let us define:

Tf: the temperature of air (gases) upon use

V(Tf): the volume of solvent saturated air enclosed in the cartridge upon use; the difference between this volume and V(Ti) depends on the elasticity of the flexible part of the cartridge;

P(Tf): the absolute pressure in the cartridge upon use. Generally, as long as the cartridge is not in overpressure, P(Tf) substantially corresponds to the operating atmospheric pressure.

Figure 3B:
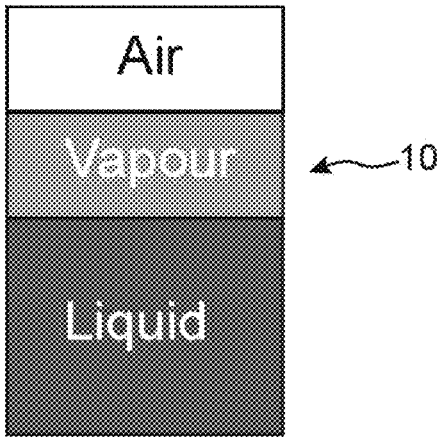

FIG. 3B schematically represents the fluid distribution in the cartridge 10 upon use of the cartridge, under conditions of temperature Tf and pressure P(Tf) which are different from those at which the filling has been made. Tf and P(Tf) can be respectively higher than Ti and P(Ti). It is noted that the overall fluid volume is then higher, in particular because of the expansion of the vapour volume and air volume.

The effect of the pressure variation causes a volume variation, possible in the elasticity sector of the flexible part of the cartridge, as long as the cartridge is not in overpressure. On the other hand, any operating atmospheric pressure higher than P(Ti) will be favourable, in that the cartridge will be less in overpressure as this operating pressure is higher than P(Ti).

Generally, the cartridge volume depends on the temperature T and is given by the sum of the volumes of liquid VL, vapour and air V:

$$VC(T) = VL(T) + V(T) = \frac{ML}{Rho(T)} + V(T)$$

ML/Rho(T) is a term varying little with respect to V(T). In the following, the liquid volume variations related to temperature are disregarded. All the variations are thus focused on V(T).

The volume variations between temperatures Ti and Tf are considered. The maximum volume of the cartridge enabling the atmospheric pressure inside the same not to be exceeded is known. This value is noted VCmax.

The filling conditions at temperature Ti are thus searched for such that, at temperature Tf, VC is at most equal to VCmax (850 $cm^3$ for example) for an atmospheric pressure equal to, or in the same order as, that present upon filling, for example 1 bar.

As regards the gases, air complies with the ideal gas law, and for vapour, the law giving saturation is applied. At any time, there is:

$V$=air volume+solvent vapour volume, which is noted:

$$V(T)=V\text{air}(T)+V\text{solvent}(T)$$

When the vapour is saturated, there is:

$$\frac{Psat(t)}{P(T)} = Vsolvent(T) / V(T)$$

$$Vsolvent(T) = V(T) * \frac{Psat(T)}{P(T)}$$

Vair(T) is calculable at temperature Ti and it is found:

$$V\text{air}(Ti)=V(Ti)*(P(Ti)-P\text{sat}(Ti))/P(Ti)$$

When the temperature switches from Ti to Tf, air complies with the ideal gas law, and it is found:

$$Vair(Tf) = Vair(Ti) * \frac{Tf}{Ti} * P(Ti) / P(Tf)$$

$$Vair(Tf) = V(Ti) * \frac{Tf}{Ti} * (P(Ti) - Psat(Ti)) / P(Tf)$$

For the solvent, the saturated vapour law is applied and there is:

$$V\text{solvent}(Tf)=V(Tf)*P\text{sat}(Tf)/P(Tf)$$

By reminding that: V(T)=Vair(T)+Vsolvent (T), there is:

$$V(Tf) = V(Ti) * \frac{Tf}{Ti} * \frac{P(Ti) - Psat(Ti)}{P(Tf)} + V(Tf) * Psat(Tf) / P(Tf)$$

By disregarding the liquid expansion, the different parameters are thus related by the following simplified relationship:

$$V(Tf) = V(Ti) * \frac{Tf}{Ti} * (P(Ti) - Psat(Ti)) / (P(Tf) - Psat(Tf))$$

which can also be noted:

$$V(Tf)=K*V(Ti)$$

The aforementioned problems, in relation with known filling methods, result from the volume VC(Tf) in the cartridge, consisting of the volume of liquid VL and of the gas volume at the ambient atmospheric temperature, being substantially greater than the maximum cartridge volume at rest VCmax. The gas volume thus has to be compressed, which increases the pressure in the pocket.

Figure 4:
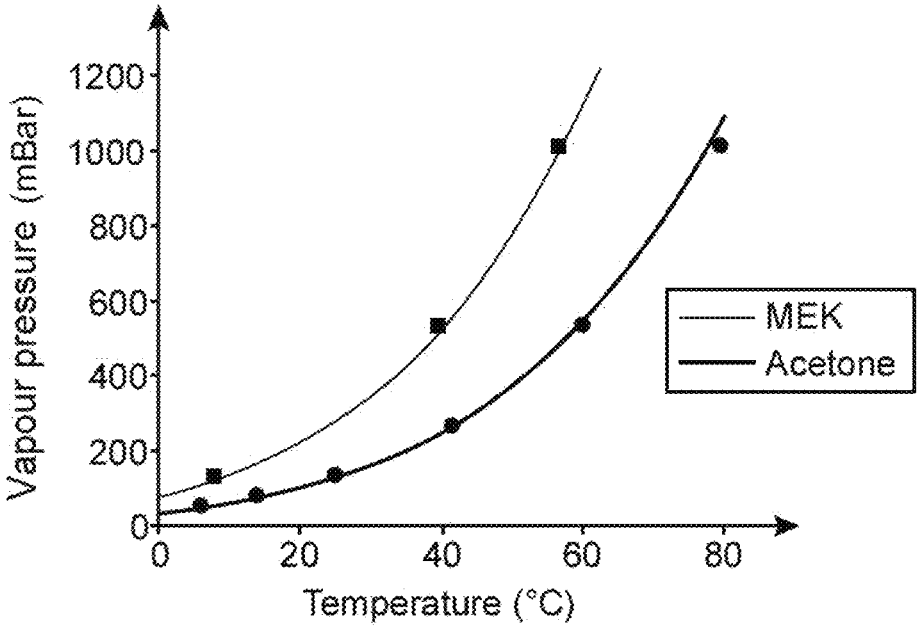
FIG. 4 represents a curve of the saturation vapour pressure as a function of temperature for MEK and acetone.

In the above formula, K*V(Ti) is easily calculable because V(Ti), Tf and Ti, P(Tf) and P(Ti) are known; as regards Psat(Ti) and Psat(Tf), they can result from the saturation vapour pressure curve as a function of temperature, at the atmospheric pressure. FIG. 4 represents those for the solvents MEK and acetone. It can be seen, for example, that the saturation vapour pressure is multiplied by about 4 between 20 and 50° C. switching from about 200 to 800 mBar for acetone and from about 100 to 400 mBar for MEK.

Thus, there is:

$$V(Tf)=K*V(Ti)$$

and $$VC(Tf)=VL+V(Tf)$$

Let us consider the % filling rate R of the cartridge, which can be that imposed by the regulations, there is: VL<(R/100)*VC(Ti) and V(Ti)=((100−R)/100)*VC(Ti); thus, by replacing VC(Ti):

$$VL<(R/(100-R))*V(Ti)$$

By replacing VL and V(Tf) with respect to the above equalities, there is obtained $$VC(Tf)=((R/(100-R))*V(Ti))+(K*V(Ti)<VC\text{max}$$

which results in:

$$V(Ti)<VC\text{max}/((R/(100-R)+K)$$

and $$VL<VC\text{max}*((R/(100-R)/(R/(100-R)+K))$$

VL and V(Ti) are then used to fill the cartridge.

The above formula enables, in a priori most detrimental conditions (for example: at the high temperature Tf) a cartridge which will not be in overpressure and will not have the previously set forth risks to be obtained: the volumes VL and V(Ti) are selected and calculated such that the resulting volume VC(Tf) is lower, or strictly lower, than the maximum volume VCmax the cartridge can hold, at a pressure equal to, or close to, the atmospheric pressure present upon filling, for example 1 bar.

For example, by taking a temperature Ti=20° C.=293 K and a maximum operating temperature 45° C. (Tf=318° K), and a detrimental difference between the initial atmospheric pressure (that upon crimping the cartridge) and the operating atmospheric pressure:

$$P(Ti)=1.030\ 10^5 \text{ Pascal and } P(Tf)=0.990\ 10^5 \text{ Pascal}$$

$$P\text{sat}(Ti)=0.23\ 10^5 \text{ Pascal and } P\text{sat}(Tf)=0.63\ 10^5 \text{ Pascal;}$$

$$V(318)=V(293)*318/293*((1.03-0.23)*10^5/(0.99-0.63)*10^5)=2.41*V(293)$$

The cartridge volume at temperature Tf will thus be:

$$VC(318)=VL+2.41*V(293) \qquad \text{[equation (1)]}$$

The transport conditions further impose a maximum filling rate (VL/VC) of 90% for acetone.

Thus, there is:

$$VC(293)=VL+V(293)=90\%\ VC(293)+V(293)$$

that is:

$$V(293)=10\%\ VC(293), VL=90\%\ VC(293)$$

and thus $$VL=9*V(293)$$

The above equation (1) becomes:

$$VC(318)=9*V(293)+2.41V(293)<VC\text{max}$$

that is:

$$V(293)<VC\text{max}/11.41$$

$$VL=9*V(293)$$

that is $$9/11.41VC\text{max}$$

For VCmax=850 $cm^3$ (according to the example), it is found:

$$V(293)<74.5\ cm^3$$

and $$VL<670\ cm^3$$

Since it could be wiser to take a margin of safety of 10% on the volume of liquid (integrating the fluid expansion and the possibility of having a greater deviation in the atmospheric pressures) a possible solution retained is:

$$V(293)=70\ cm^3+/-3\ cm^3 \text{ and } VL=600\ cm^3+/-5\ cm^3$$

In this example, it is thus chosen to fill the cartridge with a volume of liquid of about 600 $cm^3$, with a gas volume of about 70 $cm^3$.

Generally, a margin of safety between 5% and 15%, for example close to 10% can be taken. This margin of safety can be defined as the relative deviation between the chosen VL value and the calculated value to satisfy the above set out condition (the volume VC(Tf) is lower, or strictly lower, than the maximum volume VCmax the cartridge can hold, at a pressure close to the atmospheric pressure present upon filling, for example 1 bar, for a temperature between, preferably, 0 and 45° C.).

According to the invention, filling a cartridge is thus made such that the total volume contained in the cartridge results, at the operating temperature Tf, and particular if Tf is higher than Ti, in a volume VC(Tf) lower, or strictly lower, than the maximum volume VCmax the cartridge can hold, at rest, without exceeding the atmospheric pressure. It can in particular be provided that the operating temperature Tf, be between, for example, 10° C. and 35° C. or between 0° C. and 45° C. or ranges from 10° C. to 35° C. or from 0° C. to 45° C. or varies over the whole range from 10° C. to 35° C. or from 0° C. to 45° C. The volume VC(Tf) takes into account the presence, in the cartridge, of both the liquid and a gas volume, the latter containing vapour of the liquid and air.

Further, as shown in the above example, requirements imposed by the transport conditions can be taken into account; for example, these requirements impose a maximum filling rate (volume of liquid to total volume) in the order of 90%.

The calculation step and/or a method as the one above can be performed using calculating means or a calculator, for example, a microcomputer or a processor or a microprocessor, the programming of which provides taking the above-mentioned parameters into account. These means can further include means for storing data relating to these parameters, in particular saturation vapour pressure data as a function of temperature, for example as one or more curve(s), and, for a given cartridge type, at least one maximum volume VCmax datum for the cartridge.

Once the filling volume is calculated or determined, the cartridge can be filled and hermetically sealed. The cartridge is then ready for use in an ink-jet printer.

Filling the cartridge can be controlled by controlling means, including for example a microcomputer or a microprocessor or a processor, for example the one used for the above calculations. These means will enable the cartridge to be filled at the maximum calculated rate.

Instructions to implement a method according to the invention, a calculating method possibly combined with a filling method, in particular the one described above, can be performed in the form of a computer program.

The already mentioned calculating and/or controlling means can include means for reading a data medium, including data in a coded form, to implement a method according to the invention, in particular such as described above.

Alternatively, a software product includes a program data medium means, likely to be read by the calculating and/or controlling means, enabling a method according to the invention, in particular such as above, to be implemented.

An exemplary cartridge to which the invention can be applied is the one illustrated in FIG. 2 and which has already been described above.

This cartridge 10 has an elongated shape and includes a rigid part 12 and a flexible or semi-rigid part, or pocket, 14. The rigid part is provided with a mouthpiece 16 (or nose). The cartridge can have only one hermetically sealed or crimped aperture or mouthpiece or nose. Alternatively, it can have several, for example 2, hermetically sealed or crimped apertures or mouthpieces or noses, for example one such aperture for filling the cartridge and another one for feeding a printer and through which the liquid can flow from inside the cartridge towards the printing head. After being filled according to the invention, and before being set up onto the ink circuit of a printer, the cartridge only has one aperture or mouthpiece or nose, which is hermetically sealed, or several apertures or mouthpieces or noses, which are all hermetically sealed or crimped.

When it has several apertures or mouthpieces or noses, a first one of them can be used for filling the cartridge, after which step it is hermetically sealed or crimped, and a second one can be for connection to a fluidic or ink circuit of a printer, for example through a needle; the first one can remain hermetically sealed or crimped during printing.

An exemplary tool or device for implementing a filling according to a method described above, that is with a volume such as the total fluid volume, upon use at a temperature, called an operating temperature, does not exceed, or is strictly less than, the maximum volume VCmax of the empty cartridge, will now be described. The operating temperature can be as high as 35° C. or 45° C. (or less) or any temperature (or all temperatures) between 0° C. or 10° C. and 35° C. or 45° C.

Figure 5C:
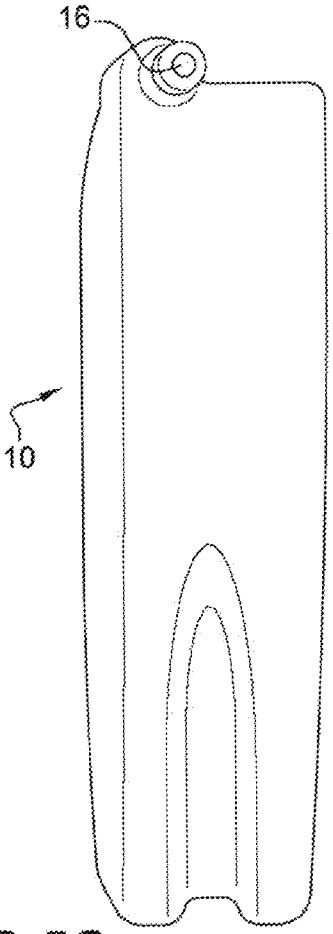
FIGS. 5A-5C, 6 and 7 represent an embodiment of a tool enabling a method according to the present invention to be implemented.
Figure 5B:
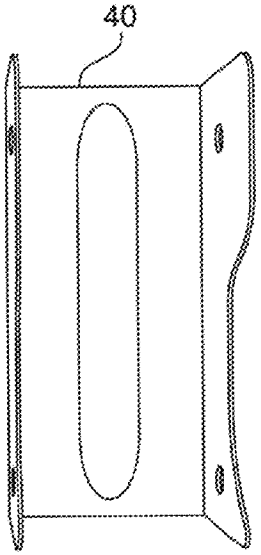
Figure 5A:
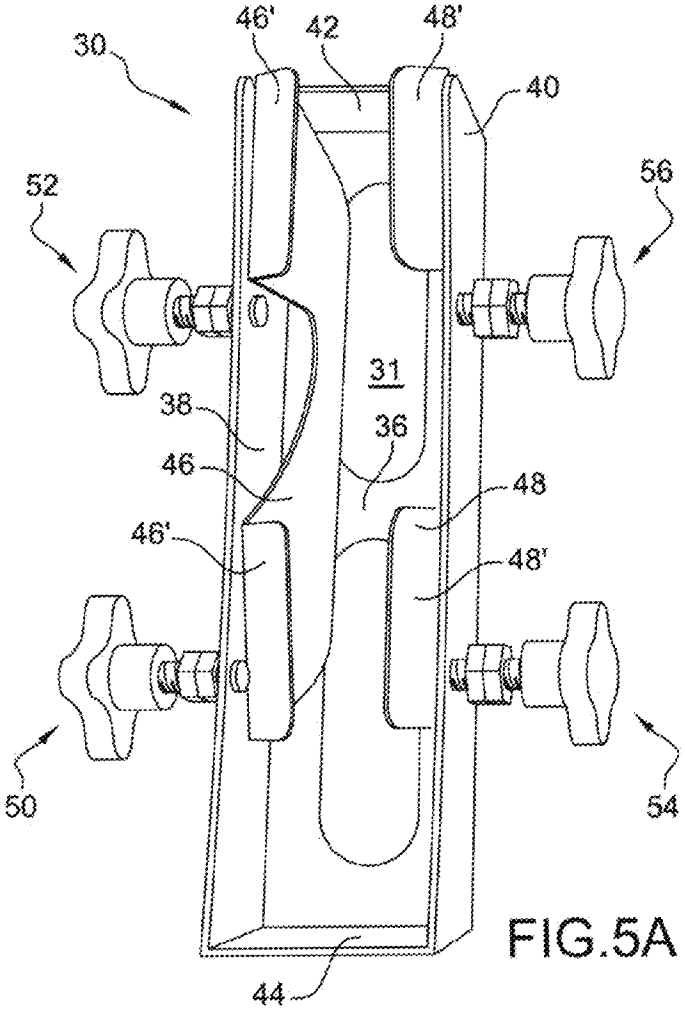

Such a tool 30 is illustrated in FIGS. 5A-5B, 6 and 7. In FIG. 5C, a cartridge is represented next to the tool.

This tool includes a housing 31 for accommodating at least the flexible part of the cartridge and means 32, 34 which will enable a stress to be applied to this flexible part to restrict the volume thereof.

The housing 31 is defined by 3 plates 36, 38, 40, including a bottom plate 36 and 2 side plates 38, 40, each being connected to the bottom plate being perpendicular thereto. It is closed by end walls 42, 44, along the longitudinal extension direction of the cartridge.

All the walls 36, 38, 40, 42, 44 define a volume 31 which is substantially parallelepiped in the example represented. The shape can be adapted depending on the cartridges, which can be of a circular, semi-circular or other section.

Figure 6:
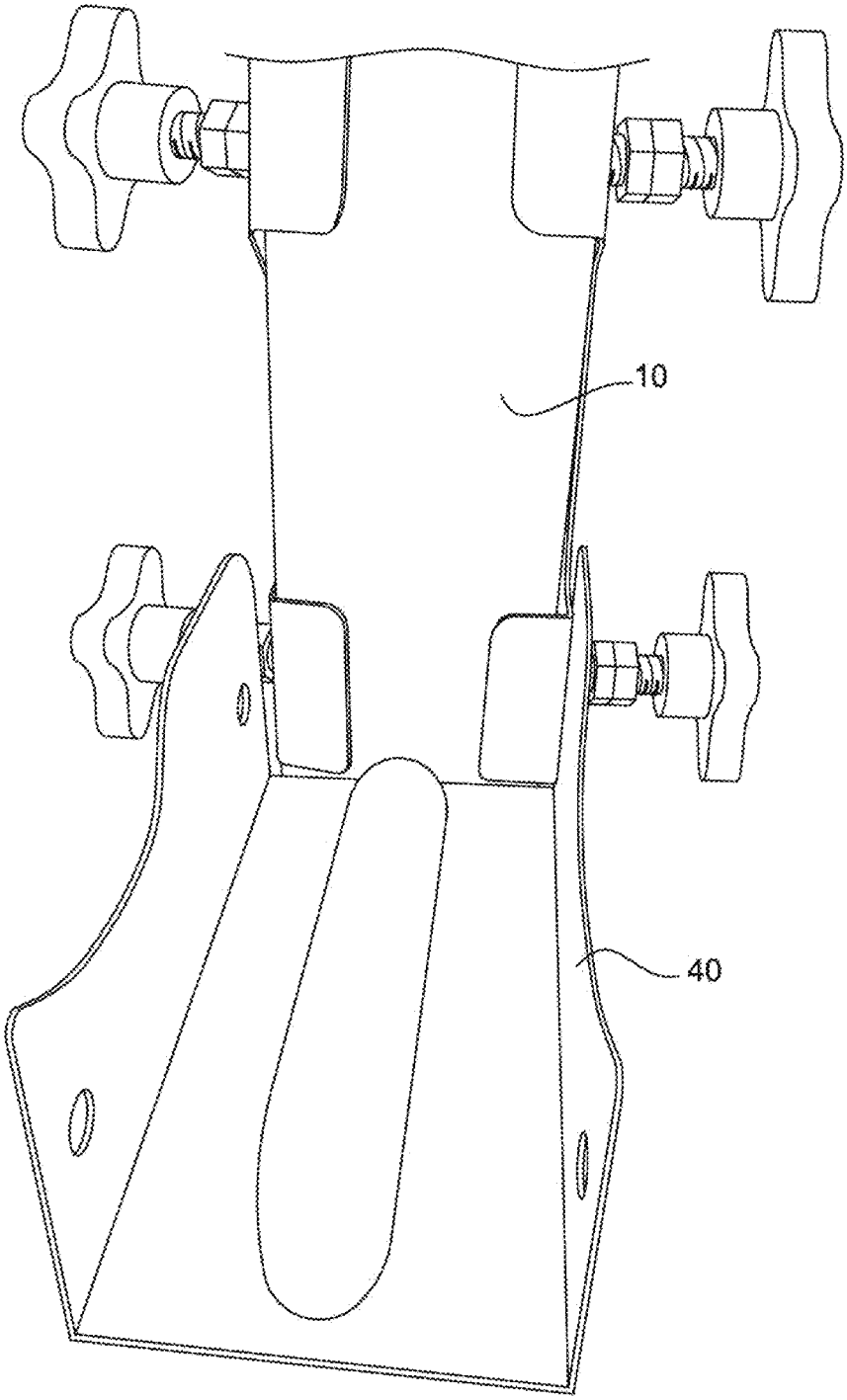
Figure 7:
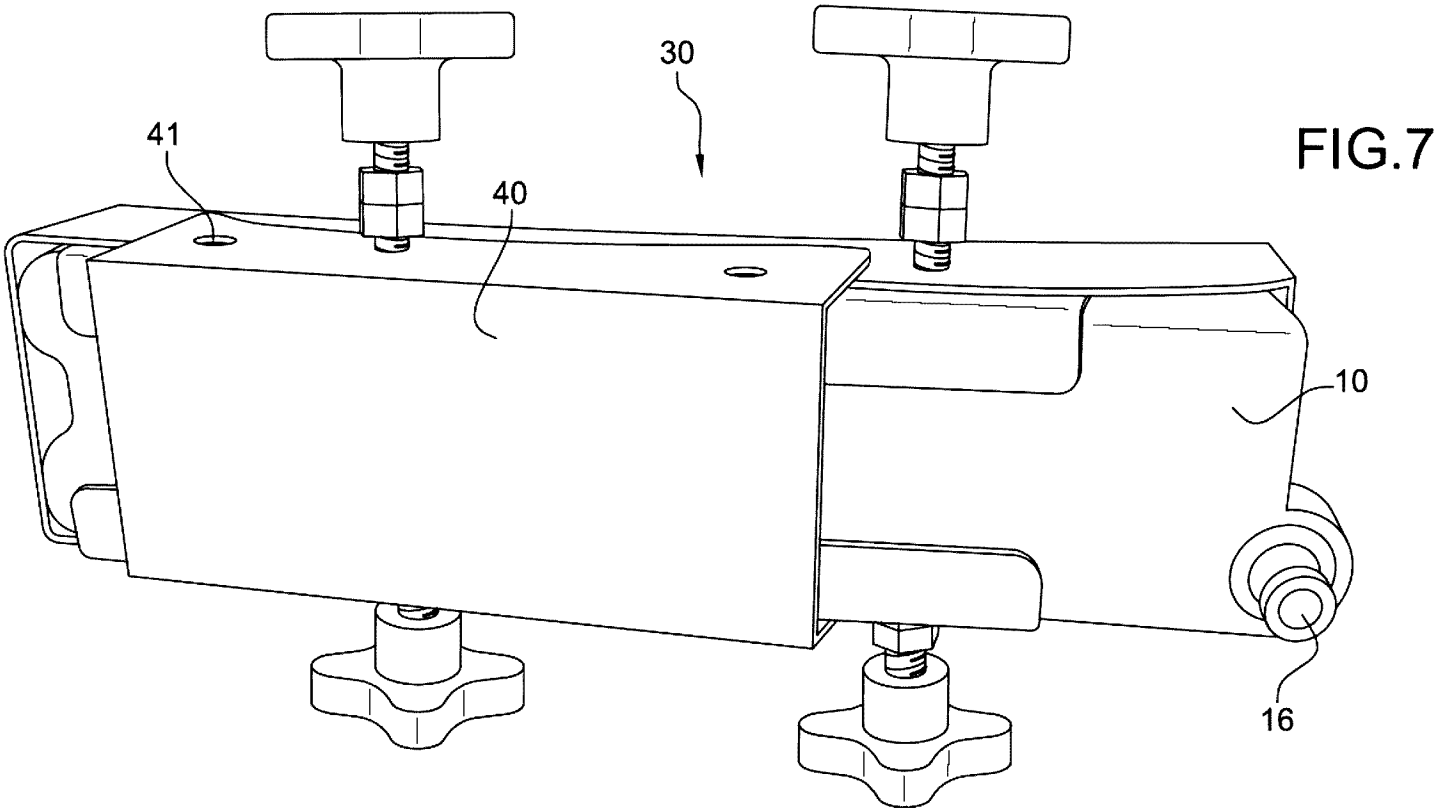

A front flap 40 (FIG. 5B) can be mounted to the tool, as illustrated in FIGS. 6 and 7. This flap can be movably mounted between an open position (FIG. 6), which enables a cartridge to be introduced into the housing 31 and a closed position (FIG. 7), which maintains a cartridge after introducing and positioning the same into the housing.

In this example, the housing further includes a first and a second flexible plate 46, 48, provided in the housing and able to be deformed under the action of one or more screws 50, 52, 54, 56. In the closed position, the part 40 can be maintained by the same screws 50, 52, 54, 56. Without any deformation, each of the flexible plates is substantially parallel to one of the side plates 38, 40 of the housing. After deformation, each moves closer to the inside of the volume 31, occupied by a cartridge at that time. The flexible plates 46, 48 can further be provided with tabs 46', 48' which enable the cartridge to be maintained in the tool 30, even before the flap 40 is closed.

After the empty cartridge is introduced into the tool, and the flap 40 is closed, the flexible plates 46, 48 are brought to a position which will restrict, at a desired value, calculated according to the method described above, the internal volume of the cartridge during its filling. The mouthpiece 16 remains accessible for introducing fluid into the cartridge, for example with help of a pump and/or a fluidic circuit connected to said cartridge. The fluid can be introduced from a reservoir or a bottle, from which it is pumped and/or circulated through said fluidic circuit. The movement of the plates can be controlled by the controlling means already mentioned above; in other words, the adjustment of the tool used can be automated, controlled by electronic means as a function of the beforehand calculated filling volume.

Once the filling is performed, the cartridge is hermetically sealed with help of a sealing device or tool. It remains in this state until it is set up on or in a printer, in particular a CLJ-type industrial printer where, for example, its aperture (herein: a mouthpiece) 16 is pierced or connected to the ink circuit in order to send ink from the cartridge to a printing head.

Alternatively the plates mentioned above can be replaced by walls or jaws or flanges or pressing surfaces.

According to another solution, the cartridge is filled in a known manner, without firstly taking into account the maximum volume according to the invention. Then, secondly, a quantity of liquid corresponding to the desired reduction in the volume of the cartridge is sucked in from the cartridge, by prohibiting an air ingress, to obtain a final volume which corresponds to the conditions set up according to the present invention. The sucking can be made through the aperture, for example the mouthpiece 16 or by another aperture, which aperture is then sealed until it is used. The same effect as above described is achieved.

According to yet another solution, the cartridge is filled in a known manner, to a volume for example close to VCmax, without a volume reduction, but at a high temperature (45° C.) or with a decreased ambient pressure. In other words, there are straightaway the most detrimental operating conditions of the cartridge. The same effect as above described is still achieved.

A cartridge according to the invention can for example be used in a printer, for example a CIJ-type industrial printer; an example of such an ink circuit wherein it can be incorporated is the one described in EP0968831.

The invention claimed is:

1. An ink and/or solvent cartridge for a printer, such said cartridge including a volume delimited by a semi-rigid or deformable pocket, said volume having a hermetically closed aperture, said volume having a given maximum capacity VCmax, defined at a balanced pressure between the inside and outside of the pocket, said volume holding a hermetically enclosed volume of liquid comprising an ink and/or a volatile solvent, and a gas volume, the sum of these 2 volumes being lower than the maximum capacity VCmax, and in the whole temperature range from 10° C. to 35° C. and for a 1 bar pressure.

2. The cartridge according to claim 1, the ratio between the sum of both volumes and VCmax being between 75% and 80%.

3. The cartridge according to claim 1, the solvent being of the alcohol, or MEK, or acetone type.

4. The cartridge according to claim 1, the cartridge having a filling rate, equal to the volume of liquid to the total volume, lower than 95%.

5. The cartridge according to claim 1, wherein the maximum capacity VCmax is between 50 $cm^3$ and 3 Liters.

6. The cartridge according to claim 1, wherein the semi-rigid or deformable pocket of the cartridge is configured to have a mechanical resilience selected to cause the semi-rigid or deformable pocket to return to an initial shape after the semi-rigid or deformable pocket is deformed and to have an under-pressure with respect to a local atmospheric pressure after the semi-rigid or deformable pocket is filled and hermetically crimped or sealed.

7. The cartridge according to claim 1, wherein the cartridge includes several hermetically sealed or closed apertures.

8. The cartridge according to claim 1, wherein the printer is a Continuous Ink Jet printer.

9. A method for filling an ink and/or solvent cartridge for a printer, such said cartridge including a volume delimited by a semi-rigid or deformable pocket, and being provided with an aperture, and having a given maximum capacity VCmax, defined at a balanced pressure between the inside and outside of the cartridge, in which the method:

a partial filling of said cartridge is conducted, by introducing therein a volume of liquid comprising an ink and/or a volatile solvent, which leaves a gas volume in the cartridge; the sum of this volume of liquid and of said gas volume, being equal to a filling volume VC, which remains lower than said maximum capacity VCmax in the whole temperature range from 10° C. to 35° C. and for a 1 bar pressure;

the aperture of said cartridge is hermetically sealed.

10. The method according to claim 9, wherein:

before introducing the liquid, a reduction in the volume of the cartridge to said filling volume VC, lower than said maximum capacity VCmax is conducted, and a volume of liquid comprising an ink and/or a volatile solvent is introduced therein, such that the sum of this volume of liquid and of the gas volume is equal to said filling volume.

11. The method according to claim 10, wherein the reduction in said volume is performed, before introducing the liquid, by applying a pressure on the deformable volume.

12. The method according to claim 9, wherein the cartridge is filled with a filling rate, or ratio of the volume of liquid to the total volume, lower than 95% or 90%.

13. The method according to claim 9, wherein the maximum capacity VCmax is between 50 $cm^3$ and 3 Liters.

14. The method according to claim 9, wherein the semi-rigid or deformable pocket of the cartridge is configured to have a mechanical resilience selected to cause the semi-rigid or deformable pocket to return to an initial shape after the semi-rigid or deformable pocket is deformed and to have an under-pressure with respect to a local atmospheric pressure after the semi-rigid or deformable pocket is filled and hermetically crimped or sealed.

15. The method according to claim 9, wherein the cartridge includes several hermetically sealed or closed apertures.

16. The method according to claim 9, wherein the printer is a Continuous Ink Jet printer.

* * * * *